US006824073B1

(12) United States Patent
Haney

(10) Patent No.: US 6,824,073 B1
(45) Date of Patent: Nov. 30, 2004

(54) FIRE PROTECTION SPRINKLER

(75) Inventor: Ian Allen Haney, 8694 Drake Dr., Anderson, CA (US) 96007

(73) Assignee: Ian Allen Haney, Anderson, CA (US)

( * ) Notice: Subject to any disclaimer, the term of this patent is extended or adjusted under 35 U.S.C. 154(b) by 0 days.

(21) Appl. No.: 10/645,403

(22) Filed: Aug. 20, 2003

(51) Int. Cl.[7] ..... B05B 15/10; B05B 15/06; A62C 31/24; A62C 35/00

(52) U.S. Cl. ..... 239/208; 239/210; 239/280; 239/280.5; 239/281; 169/16

(58) Field of Search ..... 239/208, 210, 239/280, 280.5, 281, 283; 169/5, 16, 51, 52, 67; 248/284.1, 230.1, 370, 371

(56) References Cited

U.S. PATENT DOCUMENTS 2,337,710 A * 12/1943 Cowan ..... 343/720
2,939,666 A * 6/1960 Ohre ..... 248/76
4,824,020 A * 4/1989 Harward ..... 239/264
5,263,543 A * 11/1993 Nigro ..... 169/56
5,452,872 A * 9/1995 Barnes et al. ..... 248/85
5,732,511 A * 3/1998 Scott ..... 52/1
6,109,361 A * 8/2000 Henderson ..... 169/54
6,360,968 B1 * 3/2002 Orrange et al. ..... 239/273

* cited by examiner

*Primary Examiner*—Michael Mar

(57) ABSTRACT

A fire protection system has a plurality of sprinkler assemblies connected together in series. Each sprinkler assembly has a water manifold pipe, a pair of U-shaped supports, and a sprinkler head connected to the water manifold pipe. Each U-shaped support has a pair of legs with support rotator discs affixed to upper ends of the legs for pivotally connecting the U-shaped supports to the water manifold pipe. The manifold pipe extends through manifold rotator discs affixed thereto. Locking bolts extends through respective semi-circular slots formed in the rotator discs of the U-shaped supports and the manifold rotator discs for locking the U-shaped supports in a selected pivotal angle of adjustment. During use, the support legs of the front and rear U-shaped supports are supported by front and rear roof sections of a house with the apex of the roof extending between the pair of U-shaped supports.

2 Claims, 6 Drawing Sheets

FIRE PROTECTION SPRINKLER

BACKGROUND

1. Field of Invention

This invention relates to fire protection, specifically, portable roof top sprinklers.

BACKGROUND

2. Description of Prior Art

Current methods used to prevent houses from burning during a fire is to place a standard lawn sprinkler and hope it doesn't turn over. The current roof top sprinklers as seen in U.S. Pat. No. 8,24,020 issued to Randall Harward on Apr. 25, 1989, cannot be adjusted to the angle of different roof structures, causing the system to tip over and become useless in its purpose. Installing a sprinkler system within the construction of the roof top as seen in U.S. Pat. No. 5,263,543 issued to Ralph Nigro on Nov. 23, 1993, could interfere with the integrity of the house if a leak should occur, causing costly damage to the structure before it would be detected.

OBJECTS AND ADVANTAGES

Accordingly, several objects and advantages of this invention are:

a. To provide a portable fire protection system.

b. To provide a portable fire protection system that is inexpensive.

c. To provide a portable fire protection system that can be mounted on different types of surfaces.

d. To provide a portable fire protection system that can be mounted on different shapes of surfaces.

e. To provide a portable fire protection system that can be manufactured from readily available materials.

f. To provide a portable fire protection system that can be mass produced using current manufacturing procedures.

SUMMARY OF INVENTION

The present invention is a fire protection system which can be mounted on any uneven or odd shaped surface of a roof without requiring any additional mounting apparatus. The fire protection system has a plurality of sprinkler assemblies connected together in series. Each sprinkler assembly has a water manifold pipe, a pair of U-shaped supports, and a sprinkler head connected to the water manifold pipe. Each U-shaped support has a pair of legs with support rotator discs affixed to upper ends of the legs for pivotally connecting the U-shaped supports to the water manifold pipe. The manifold pipe extends through manifold rotator discs affixed thereto. Locking bolts extends through respective semi-circular slots formed in the rotator discs of the U-shaped supports and the manifold rotator discs for locking the U-shaped supports in a selected pivotal angle of adjustment. During use, the support legs of the front and rear U-shaped supports are supported by front and rear roof sections of a house with the apex of the roof extending between the pair of U-shaped supports.

REFERENCE NUMERALS IN DRAWINGS

Figure 1:
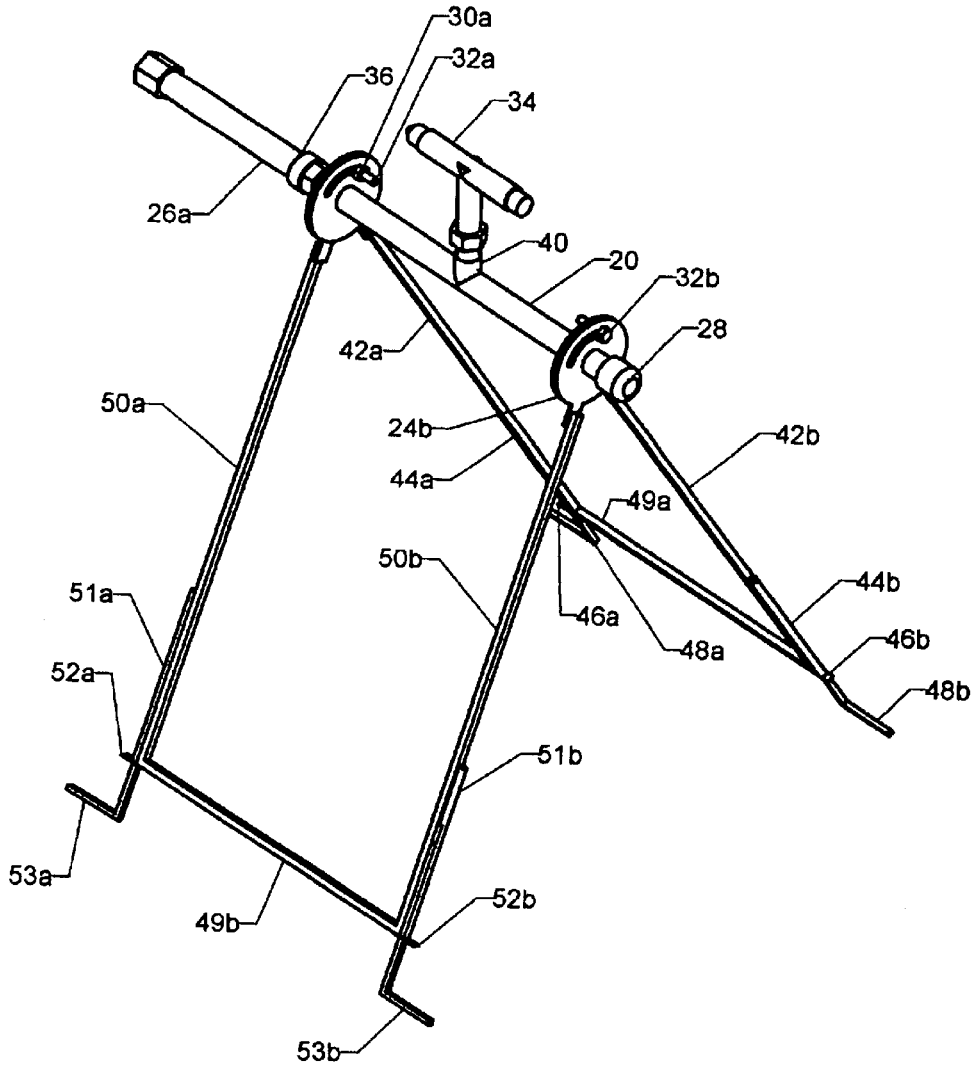
FIG. 1 shows a perspective view of the fire protection system.
Figure 2:
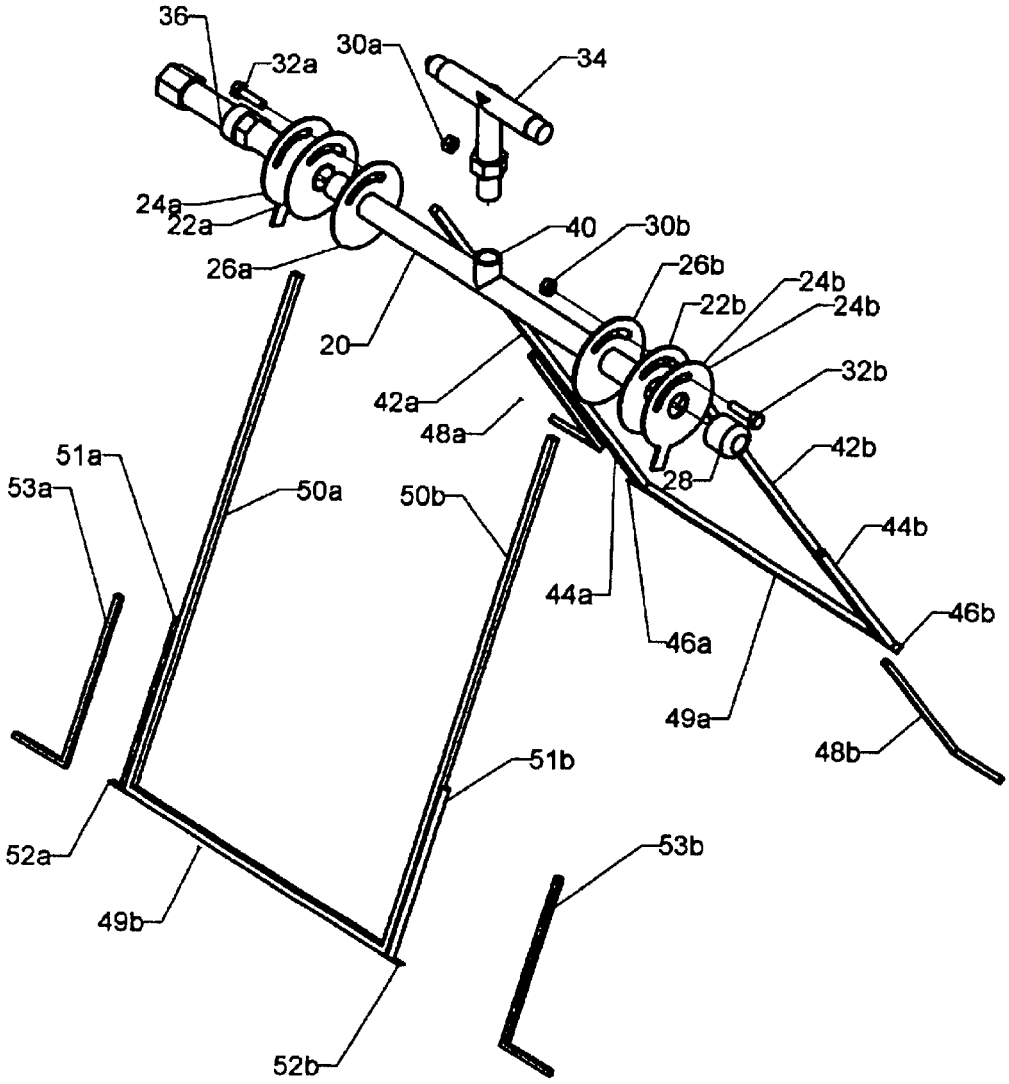
FIG. 2 shows an exploded perspective view of the fire protection system.

18 Fire Protection Sprinkler system
20 Water manifold
22*a* Left side rear support rotator disc
22*b* Right side rear support rotator disc
23*a* Left side rear support rotator disc slot
23*b* Right side rear support rotator disc slot
24*a* Left side front support rotator disc
24*b* Right side front support rotator disc
25*a* Left side front support rotator disc slot
25*b* Right side front support rotator disc slot
26*a* Left side water manifold rotator disc
26*b* Right side water manifold rotator disc
27*a* Left side water manifold rotator disc slot
27*b* Right side water manifold rotator disc slot
28 Water manifold connecting plug
30*a* Left side threaded nut
30*b* Right side threaded nut
32*a* Left side bolt
32*b* Right side bolt
34 Sprinkler head assembly
36 Water manifold hose bib assembly
40 Water manifold to sprinkler assembly connector tee
42*a* Left side rear support leg
42*b* Right side rear support leg
44*a* Left side rear support leg adjuster tube
44*b* Right side rear support leg adjuster tube
46*a* Left side rear support leg adjuster lock device
46*b* Right side rear support leg adjuster lock device
48*a* Left side rear support adjuster leg
48*b* Right side rear support adjuster leg
49*a* Left side and Right side rear support leg connector
49*b* Left side and Right side front support leg connector
50*a* Left side front support leg
50*b* Right side front support leg
51*a* Left side front support leg adjuster tube
51*b* Right side support leg adjuster tube
52*a* Left side front support leg adjuster lock device
52*b* Right side front support leg adjuster lock device
53*a* Left side front support leg adjuster
53*b* Right side front support leg adjuster
54 House
55 Water Spray

DETAILED DESCRIPTION

The preferred embodiment of the Fire Protection Sprinkler system of the present invention is illustrated in FIG. 1, a perspective view of the fire protection system. The water manifold 20 freely supports the left side rear support rotator disc 22*a*, right side rear support rotator disc 22*b*, left side front support rotator disc 24*a*, and right side front support rotator disc 24*b* at the through hole at approximately the center of the diameter of the discs. The planer surface of the left side rear support rotator disc 22*a*, right side rear support rotator disc 22*b*, left side front support rotator disc 24*a*, right side front support rotator disc 24*b* are positioned perpendicular to the surface of the water manifold 20. The left side rear support rotator disc 22*a* and left side front support rotator disc 24*a* are positioned to the left side of the water manifold 20 closest to the water manifold hose bib assembly 36. The right side rear support rotator disc 22*b* and right side front support rotator disc 24*b* are positioned at the right side of the water manifold 20 closest to the water manifold connection plug 28. The left side water manifold rotator disc 26*a*, is fixed securely at the left side of the water manifold 20 so that the rotational movement along the linear axis of water manifold 20 is transferred to the axis of the left side water manifold rotator disc 26*a*. The right side water manifold rotator disc 26*b*, is fixed securely on the right side of the water manifold 20 so that the rotational movement along the linear axis of the water manifold is transferred to the axis of the right side water manifold rotator disc 26*b*. The left side front support rotator disc 24*a* is sandwiched between the left side rear support rotator disc 22*a* and the left side water manifold rotator disc 26*a*. The left side bolt 32*a* passes through slots 23*a*, 25*a*, and 27*a* with the left side nut 30*a* screwing onto the left side bolt 32*a*. This applies a clamping force to the planer surfaces of the left side rear support rotator disc 22*a*, left side front support rotator disc 24*a*, left side water manifold rotator disc 26*a*, thus restricting the rotational movements of the left side disc assembly. The right side front support rotator disc 24*b* is sandwiched between right side rear support rotator disc 22*b* and right side water manifold rotator disc 26*b*.

Right side bolt 32*b* passes through slots 23*b*, 25*b*, 27*b* with right side nut 30*b* screwing onto right side bolt 32*b* thus applying clamping force to the planer surfaces of right side rear support rotator disc 22*b*, right side front support rotator disc 24*b*, right side water manifold rotator disc 26*b*, restricting the rotational movements of right side rear support rotator disc 22*b*, right side front support rotator disc 24*b*, right side water manifold rotator disc 26*b* securing right side rear support rotator disc 22*b*, right side front support rotator disc 24*b*, right side water manifold rotator disc 26*b* from any movements about the planer surfaces of right side rear support rotator disc 22*b*, right side front support rotator disc 24*b*, right side water manifold rotator disc 26*b*.

Leg 42*a* and 42*b* are connected at the end portion of the leg to the end portions of rear leg support connector 49*a* forming a u-shape support member. The remaining end of the leg 42*a* is attached securely to the outer diameter of the left side rear support rotator disc 22*a* at a point opposite the slot 23*a* on the left side rear support rotator disc 22*a*. The remaining end of the leg 42*b* is attached to the outer diameter of right side rear support rotator disc 22*b* at a point opposite the slot 23*b* on right side rear support rotator disc 22*b*. Legs 50*a* and 50*b* are connected at the end portion of the leg to the end portions of front leg support connector 49*b* forming a u-shape support member. The remaining end of the leg 50*a* is attached securely to the outer diameter of the left side front support rotator disc 24*a* at a point opposite the slot 25*a* on the left side front support rotator disc 24*a*. The remaining end of the leg 50*b* is attached to the outer diameter of the right side front support rotator disc 24*b* at a point opposite the slot 25*b* on right side front support rotator disc 24*b*.

Left side rear support leg adjuster tube 44*a* is permanently attached to the left side rear support leg 42*a*, facing out at the lower portion of the left side rear support leg 42*a*. Left side rear support adjuster leg 48*a* is inserted through the left side rear support leg adjusted tube 44*a*. The diameter of the left side rear support adjuster leg 48*a* is sufficiently smaller in diameter than the diameter of the left side rear support leg adjuster tube 44*a*. This allows the left side rear support leg adjuster 44*a* to move freely in the left side rear support leg adjuster tube 44*a*.

When the left side rear support adjuster leg 48*a* is positioned where it is in the correct location the locking device 46*a* locks the left side rear support adjuster leg 48*a* in place. Right side rear support leg adjuster tube 44*b* is permanently attached to the right side rear support leg 42*b*, facing out at the lower portion of the right side rear support leg 42*b*. Right side rear support adjuster leg 48*b* is inserted through the right side rear support leg adjuster tube 44*b*. The diameter of the right side rear support adjuster leg 48*b* is sufficiently smaller in diameter than the diameter of the right side rear support leg adjuster tube 44*b*. This allows the right side rear support leg adjuster 48*b* to move freely in the right side rear support leg adjuster tube 44*b*. When the right side rear support adjuster leg 48*b* is positioned where it is in the correct location the locking device 46*b* locks the right side rear support adjuster leg 44*b* in place. Right side front support leg adjuster tube 51*b* is permanently attached to the right side front support leg adjuster 53*b*, facing out at the lower portion of the right side front support leg 50*b*. Right side front support leg adjuster 53*b* is inserted through the right side front support leg adjuster tube 51*b*. The diameter of the right side front support leg adjuster 53*b* is sufficiently smaller in diameter than the diameter of the right side front support leg adjuster tube 51*b*. This allows the right side front support leg adjuster 53*b* to move freely in the right side front support leg adjuster tube 51*b*.

When the right side front support leg adjuster 53*b* is positioned where it is in the correct location the locking device 52*b* locks the right side front support leg adjuster 53*b* in place. Left side front support leg adjuster tube 51*a* is permanently attached to the left side front support leg adjuster 53*a*, facing out at the lower portion of the left side front support leg 50*a*. Left side front support leg adjuster 53*a* is inserted through the left side front support leg adjuster tube 51*a*. The diameter of the left side front support leg adjuster 53*a* is sufficiently smaller in diameter than the diameter of the left side front support leg adjuster tube 51*a*. This allows the left side front support leg adjuster 53*a* to move freely in the left side front support leg adjuster tube 51*a*. When the left side front support leg adjuster 53*a* is positioned where it is in the correct Location the locking device 52*a* locks the right side front support leg adjuster 53*a* in place.

Figure 3:
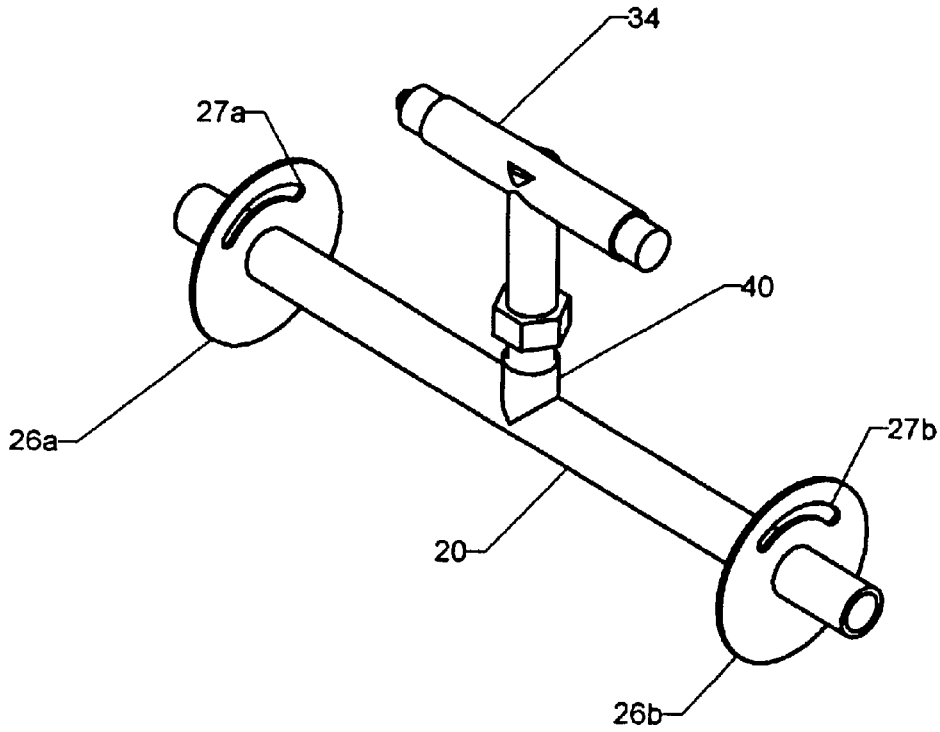
FIG. 3 shows a perspective view of the Water manifold assembly with a sprinkler head attached.
Figure 4:
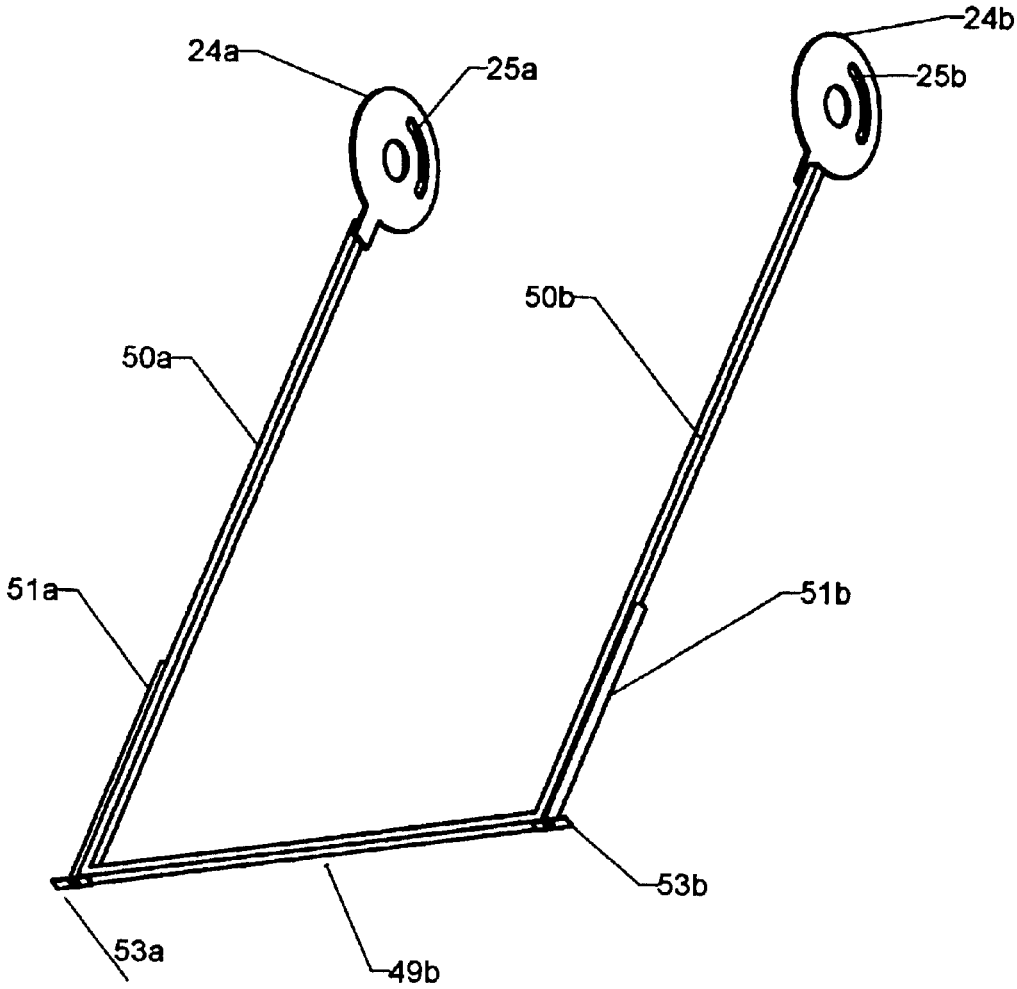
FIG. 4 shows a perspective view of the outside stand assembly with rotator plates attached.
Figure 5:
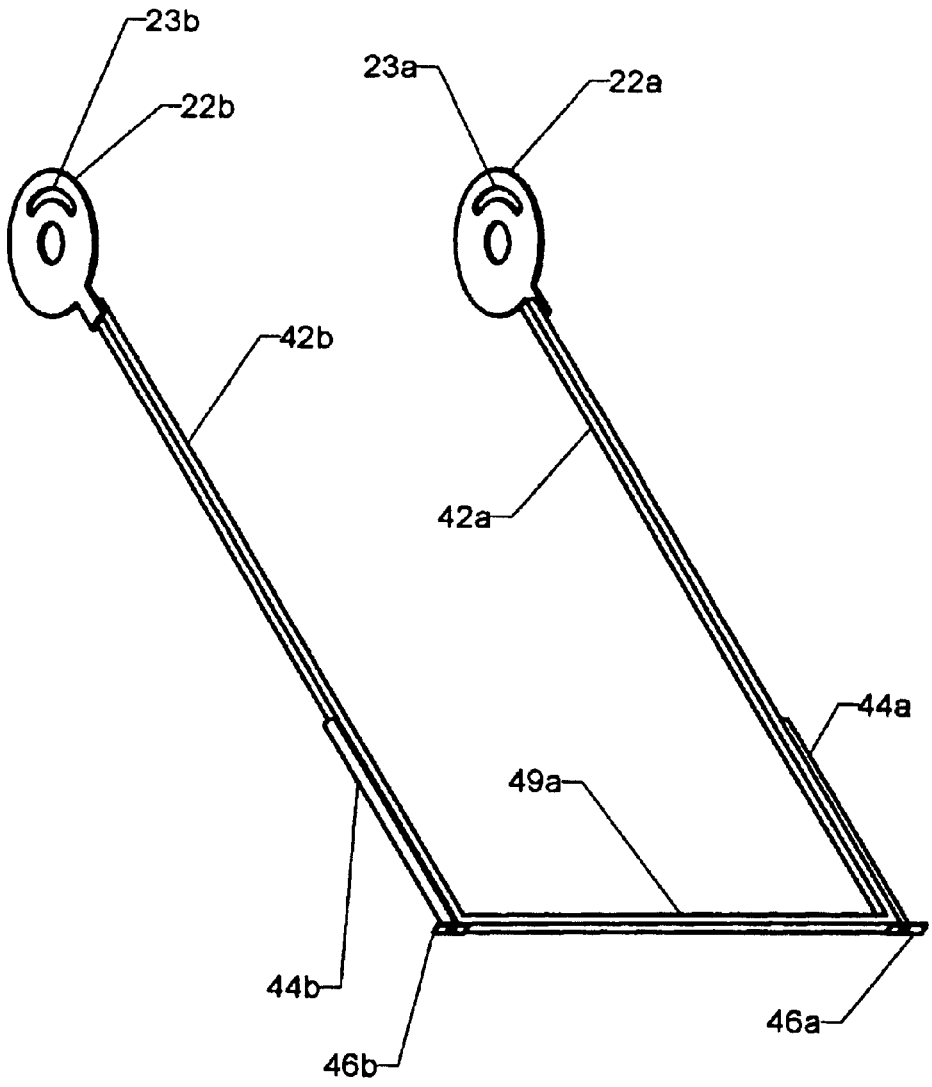
FIG. 5 shows a perspective view of the inside stand assembly with rotator plates attached.

The fire protection sprinkler system water manifold of the present invention is illustrated in FIG.3. The left side water manifold rotator disc 26*a* is showing the left side water manifold rotator disc slot 27*a* near the outer edge of the planer surface of the left side water manifold rotator disc 26*a*. The right side water manifold rotator disc 26*b* is showing the right side water manifold rotator disc slot 27*b* near the outer edge of the planer surface of the right side water manifold rotator disc 26*b* The water manifold sprinkler assembly connector tee 40 is secured to the water manifold 20 facilitating the attachment of the sprinkler head assembly 34.

Figure 6:
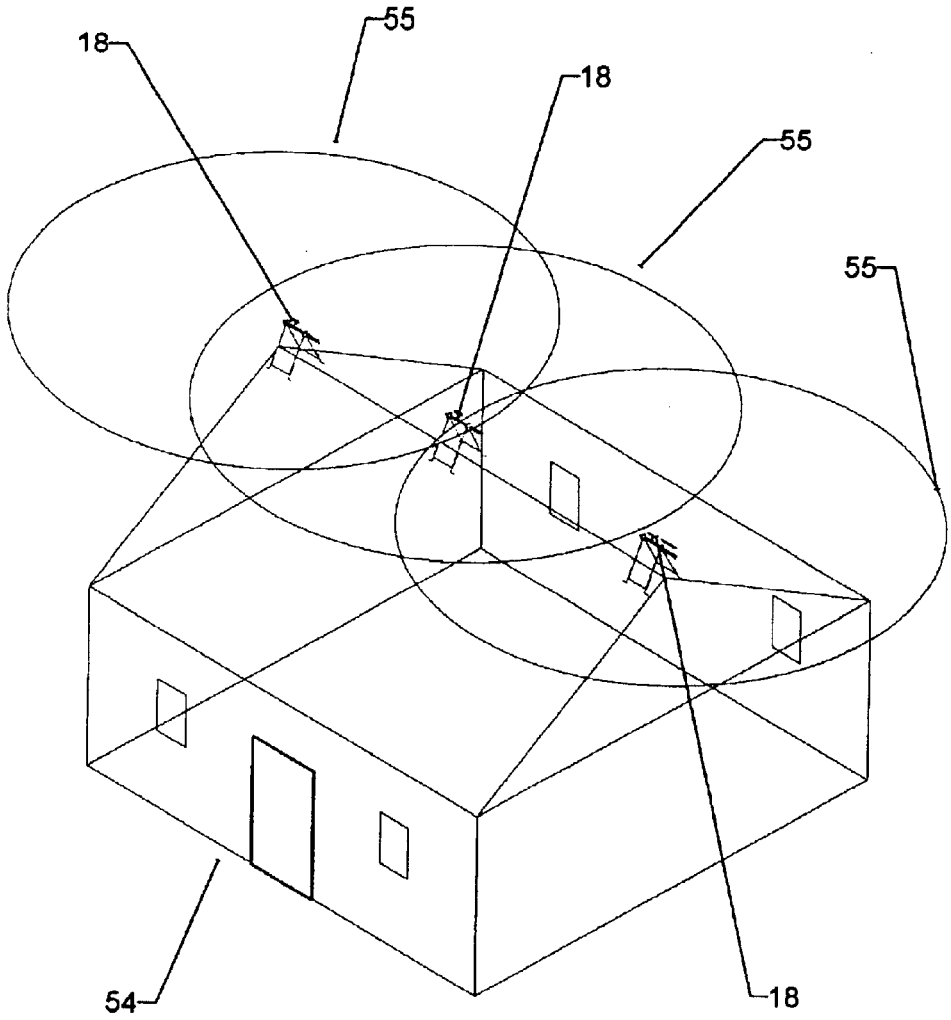
FIG. 6 shows a perspective view of a multitude of fire protection systems attached to the roof of a house with a spray of water emitting from the spray heads.

A perspective view is illustrated in FIG. 6 showing a multitude of Fire Protection Systems 18 attached to the roof of a house 54 with a spray of water 55 emitting from the spray heads of the fire protection sprinkler systems 18.

Accordingly, the reader will see that the fire protection system of this invention can be used conveniently, inexpensively and can be set up quickly. It can be made of different materials. It can be made using different dimensions, such as, making it taller, shorter, wider, narrower, lighter, heavier, or in whatever configurations not stated. It allows for an easy and quick setup in emergency situations. Although the description above contains much specificity, these should not be construed as limiting the scope of the invention, but as merely providing illustrations of some of the presently preferred embodiments of this invention. For example, the water delivery system can range from the standard tap water supply to a pressurized, electronically controlled, or a liquid filled tank system. Thus, the scope of the invention should be determined by the appended claims and their legal equivalents, rather than by the examples given.

What is claimed is:

1. A fire protection system comprising in combination:

a house including a plurality of side walls and a roof formed in an inverted V-shaped configuration, the roof having front and rear sections each including lower edges, a centrally positioned apex defining the highest point of the roof; and a plurality of sprinkler assemblies connected together in series, each sprinkler assembly comprising a water manifold pipe having an inlet end and an outlet end, the inlet end of a first one in the series of sprinkler assemblies being connected to a pressurized source of water, the outlet end of a last one in the series of sprinkler assemblies being closed by a blocking device to terminate the flow of pressurized water, a hollow tee connector affixed at a right angle to a longitudinal axis of the water manifold pipe;

a sprinkler head connected to the tee connector; and a support assembly having:

front and rear U-shaped supports, each U-shaped support having a pair of legs with lower ends being interconnected by a support leg connector;

left and right front support rotator discs affixed to respective upper ends of the pair of legs of the front U-shaped support, each front rotator disc having a central circular opening for rotatably receiving the manifold tube therethrough and a slot formed in a semi-circular pattern;

left and right rear support rotator discs affixed to respective upper ends of the pair of legs of the rear U-shaped support, each rear rotator disc having a central circular opening for rotatably receiving the manifold tube therethrough and a slot formed in a semi-circular pattern;

left and right manifold rotator discs, the manifold pipe extending through the left and right manifold rotator discs and affixed thereto with the tee connector positioned therebetween, each manifold rotator disc having a slot formed in a semi-circular pattern, wherein the U-shaped supports are pivotably adjustable to a spaced apart selected position for receiving the apex of the roof therebetween with the longitudinal axis of the water manifold pipe extending substantially parallel to a longitudinal axis of the apex of the roof, the U-shaped supports being lockable in the selected position by left and right locking bolts extending through respective slots in the left and right rotator discs of the front and rear U-shaped supports and the manifold.

2. A fire protection system as recited in claim 1, wherein each pair of legs of the U-shaped support has a support leg adjustor tube attached thereto in which a support leg adjuster is telescopically inserted, the support leg adjuster being selectively secured in an adjusted position by a locking device.

* * * * *